United States Patent [19]

Leffler

[11] 3,985,005

[45] Oct. 12, 1976

[54] APPARATUS FOR PROCESSING LIQUID-CONTAINING SUBSTANCE MIXTURES, PARTICULARLY CELLULOSE PULP

[75] Inventor: Nils Gustav Leffler, Sundsvall, Sweden

[73] Assignee: Sunds Aktiebolag, Sundsvall, Sweden

[22] Filed: Mar. 11, 1975

[21] Appl. No.: 557,413

[30] Foreign Application Priority Data

Mar. 14, 1974 Sweden ..... 7403408

[52] U.S. Cl. ..... 68/181 R; 210/331; 210/345

[51] Int. Cl.[2] ..... D21D 5/02

[58] Field of Search ..... 68/181 R, 183; 162/60, 162/251; 210/333, 331, 344, 345

[56] References Cited

UNITED STATES PATENTS

| | | | |
|---|---|---|---|
| 3,078,703 | 2/1963 | Richter et al. | 68/181 R |
| 3,237,773 | 3/1966 | Laakso | 68/181 R |
| 3,298,209 | 1/1967 | Laakso | 68/181 R |
| 3,298,900 | 1/1967 | Laakso | 68/181 R X |
| 3,443,697 | 5/1969 | Seggebruch | 210/344 |
| 3,677,040 | 7/1972 | Pettersson | 68/181 R |
| 3,704,603 | 12/1972 | Richter | 68/181 R X |
| 3,729,961 | 5/1973 | Leffler | 68/181 R |
| 3,815,386 | 6/1974 | Gullichsen et al. | 68/181 R |
| 3,879,286 | 4/1975 | Berriman | 210/331 X |

*Primary Examiner*—Philip R. Coe

*Attorney, Agent, or Firm*—Lerner, David, Littenberg & Samuel

[57] ABSTRACT

An apparatus for concentration of or liquid treatment of liquid-containing substance mixtures, particularly cellulose pulp, in which a preferably upright container is adapted for axial flow of cellulose pulp therethrough. A plurality of screen bodies which have outlets and are mounted in the container and have perforated or slotted walls for the collection of liquid separated from the cellulose pulp are provided. The screen bodies are arranged substantially radially in the cross-section of the container and extend from the periphery of the container to a filling body or the like provided in the container preferably centrally therein.

25 Claims, 12 Drawing Figures

FIG. 11
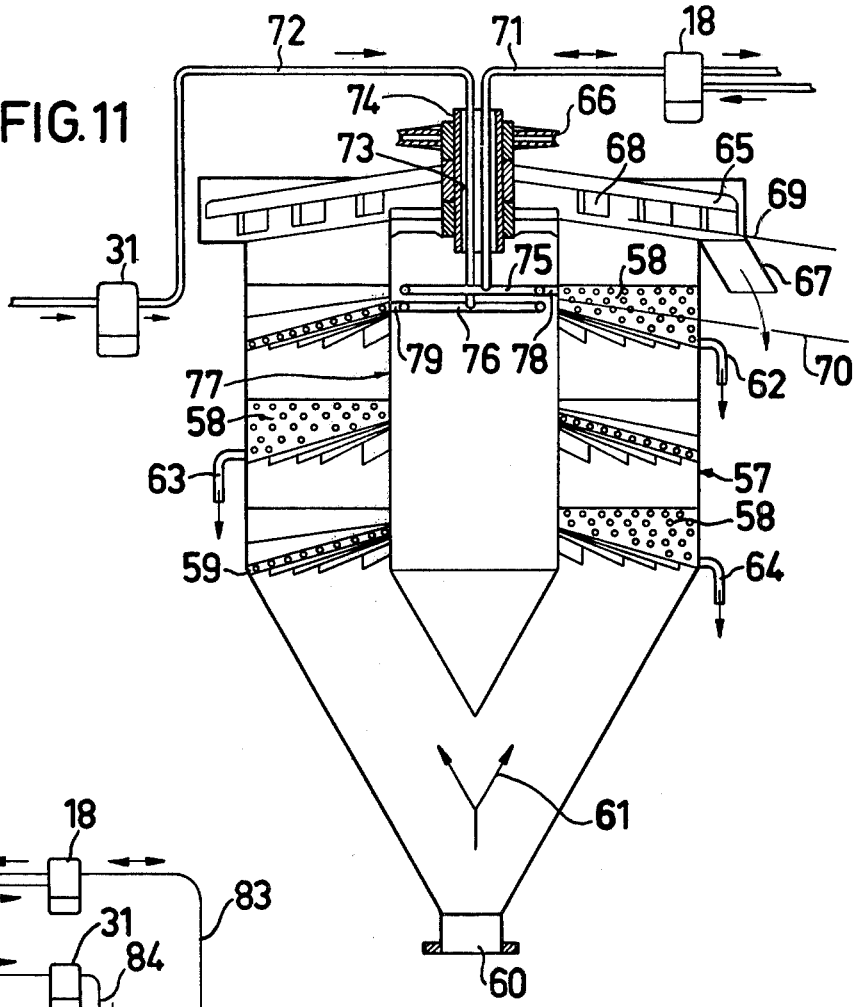
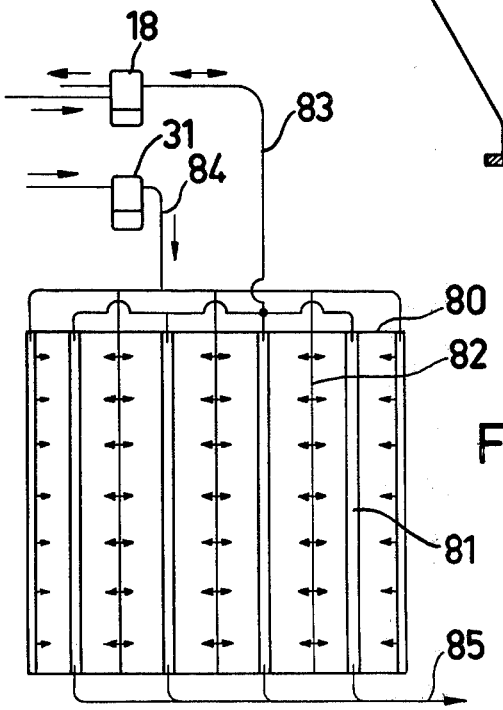
FIG. 12

APPARATUS FOR PROCESSING LIQUID-CONTAINING SUBSTANCE MIXTURES, PARTICULARLY CELLULOSE PULP

BACKGROUND OF THE INVENTION

This invention relates to an apparatus and such containers for the processing of liquid-containing substance mixtures, particularly fiber pulp suspensions of cellulose pulp, which are designed for axial flow of the fiber pulp suspension and comprise at least one set of screen bodies disposed substantially on the same level for screening-off liquid which is not desired in subsequent treatment steps. This treatment of the fiber pulp suspension can be carried out by concentration, washing, chemical treatment, particularly bleaching, or similar treatments with the object of removing at least part of the liquid, in which the fiber pulp is suspended.

When there is a pulp concentration of 2–4% to 8–15%, the liquid amount to be removed is drained through the screen bodies without supply of compensating liquid. When washing or bleaching, particularly when so-called dynamic bleaching, treatment liquid is supplied through special means. The treatment liquid may be water or washing liquid or liquid of a chemical strength lower than that of the suspension liquid to be exchanged and, respectively, bleaching liquid, extraction liquid such as alkali or water. The supply means are located in connection to the screen bodies in such a way that the agent supplied is passed through the fiber pulp suspension transversely in relation to the flow direction of the suspension. As a result of this transverse flow, the liquid, in which the cellulose-containing material is suspended, is replaced entirely or partially by the liquid supplied.

Known designs of the aforesaid apparatus are provided with a plurality of cylindric screen bodies, which have different diameters and are arranged concentrically for screening across the entire cross-section of the container. Treatment liquid is spread between the screen bodies from spray pipes rotating in concentric paths to spread the liquid in two opposed radial directions. One difficulty in this conjunction is to distribute the liquid in correct proportions in one and the other direction, because the liquid most readily flows radially outward to the larger screen surface on the outer screen body. Attempts have been made to counteract this inconvenience by a number of measures which, however, did not bring about a fully satisfactory result. The problems with concentric cylindric screen bodies is mirrored by the discussion covered in the Swedish patent specifications 225 814, 341 654, and 342 270. A further inconvenience in conjunction with cylindric screen bodies is the difficulty of access to the screen bodies for inspection, cleaning and exchange.

SUMMARY OF THE INVENTION

In order to avoid and overcome the above problems, an apparatus is provided for the concentration and/or liquid treatment of cellulose pulp. Liquid treatment may be washing or bleaching. The apparatus of the present invention comprises an upright container adapted for axial flow of cellulose pulp therethrough, and a plurality of screen bodies which have outlets and are mounted in the container. The screen bodies have perforated or slotted walls for the collection of liquid separated from the cellulose pulp and the screen bodies are arranged substantially radially in the cross-section of the container and extend from the periphery of the container to a filling body or the like provided in the container preferably centrally therein. The screen surfaces of the screen bodies are vertical or substantially vertical and the height of the screen surfaces of the screen bodies is substantially constant along the radial extension of the screen bodies. Alternatively, the height of the screen surfaces of the bodies can decrease in the radial direction with reduced distance from the axis line of the container. The ratio between the height of the screen surfaces on the screen bodies at the periphery of the container and the height at the periphery of the filling body is substantially equal to the square of the ratio between the distance of the screen surfaces relative to each other at the periphery of the container and filling body, respectively. Alternatively, the ratio between the height of the screen surfaces on the screen bodies at the periphery of the container and the height at the periphery of the filling body may be equal to the ratio between the distance of the screen surfaces relative to each other at the periphery of the container and the filling body respectively. Still alternatively, the ratio between the height of the screen surfaces on the screen body at the periphery of the container and the height at the periphery of the filling body may be at a maximum equal to the ratio $a^2:b^2$ and at a minimum to the ratio $a:b$. It may even be possible that the ratio is a value smaller than the ratio $a:b$. The screen bodies may include an undivided cavity between two perforated wall portions. Alternatively, the cavity may be divided by a partition wall. The perforated or slotted wall portions of the screen bodies may be substantially parallel. The distance between the perforated or slotted walls in the screen bodies may decrease with reduced distance from the axis line of the container, i.e., the screen bodies are wedge-shaped seen in a normal plane to the axis line of the container. The outer end wall of the screen bodies at the periphery of the container may be provided with a detachable cover and/or inspection glass to render possible the cleaning from within and, respectively, the inspection of the screen bodies during through flow of cellulose pulp. The screen bodies themselves may be dismountable and moutable from outside the container by radial movement, thus making them easier to clean. Apparatus is also arranged so that the screen bodies are connected to at least one conduit provided to transfer pressure impulses of liquid or gas from a pressure source by a relay controled solenoid. Each screen body half may be connected to at least one separate conduit provided for transferring pressure impulses. A valve may be provided to transfer pressure impulses at timed intervals or, alternatively, to transfer pressure impulses substantially continuously. The drain openings of the screen bodies may be connected to means provided to hold the drain openings closed during transfer of the pressure impulses. The drain openings and the drain conduits of the screen bodies are continuously defined toward the ambient by liquid traps. The conduits for transfer of the pressure impulses and the conduits for drained liquid are connected to the screen body at the periphery of the container, or, alternatively, at the periphery of the portion of the filling body. A centrally located valve is provided to transfer pressure impulses to the screen bodies and, when required, to close the drain openings of the screen bodies during transfer of the pressure impulses. Means are provided with a shield for a guiding treatment liquid supplied on both sides of the shield in the desired direction. Additionally, further means may be provided to supply treatment liquid on different levels between the screen bodies. In addition, the means for supplying treatment liquid may have a decreasing width with reduced distance from the axis line of the container, seen in a normal plane through the container. Additionally, a tower scraper is provided at the upper portion of the container for discharging treated cellulose pulp to a shaft. The lower edge of the scraper blade of the tower scraper may be, when rotating, describing an area, the generatrix of which, seen in an axial plane through the axis line of the container, is in parallel with a center line for the perforated screen surface of the screen body.

Although this invention will be described with respect to its preferred embodiments, it should be understood that many variations and modifications will be obvious to those skilled in the art, and it is preferred, therefore, that the scope of the invention be limited, not by the specific disclosure herein, but only by the appended claims.

DETAILED DESCRIPTION OF THE DRAWINGS

Figure 6:
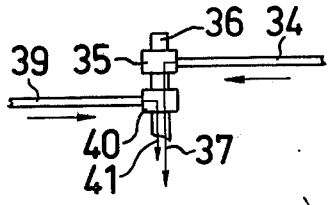
Figure 1:
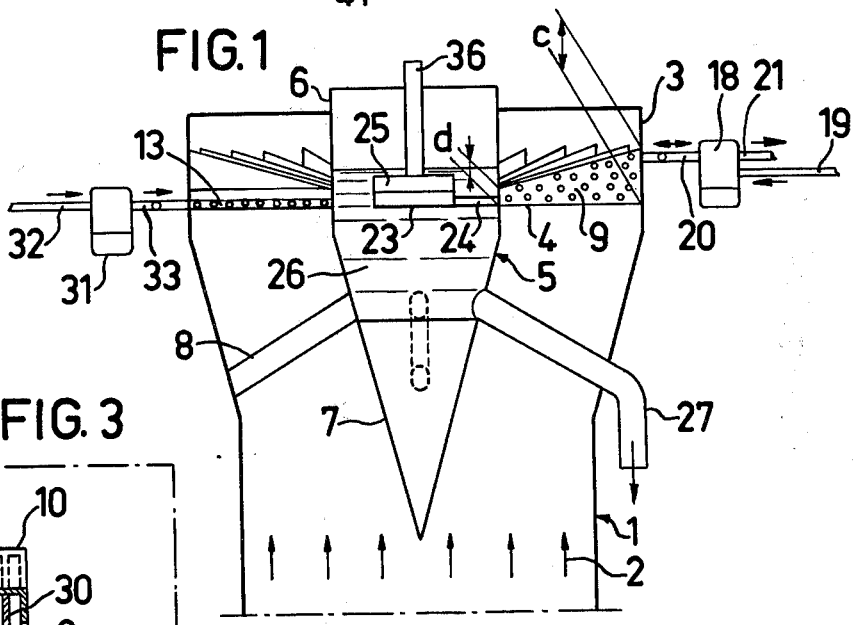
Figure 3:
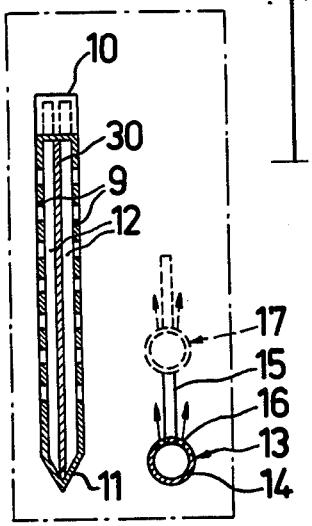
Figure 2:
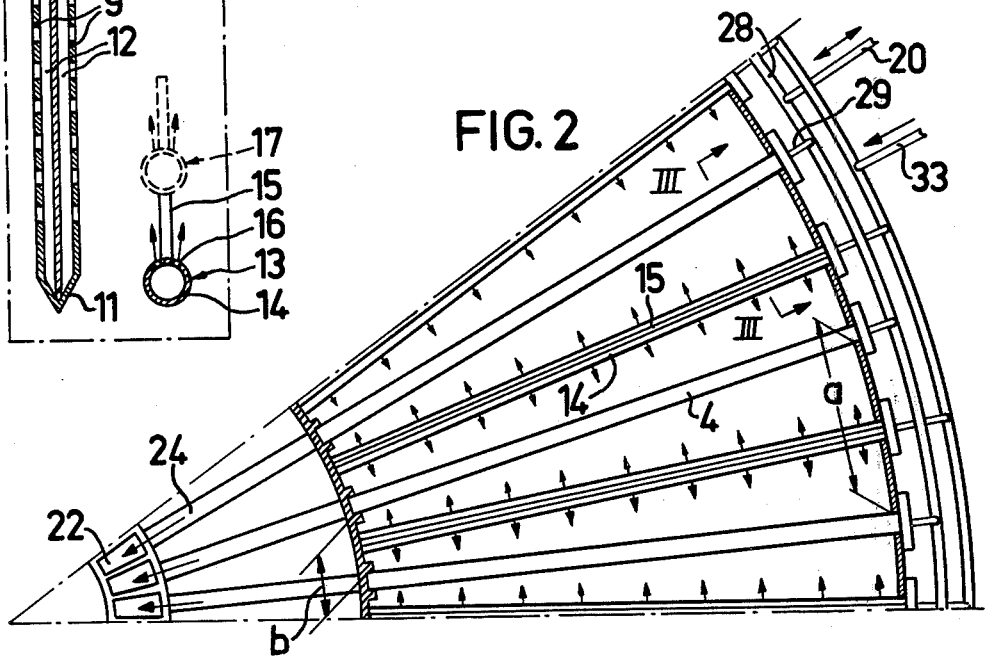
Figure 4:
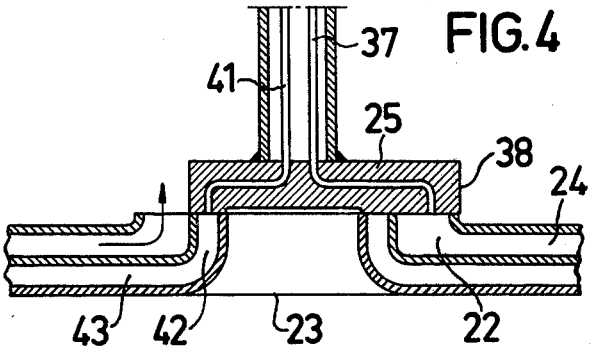
Figure 5:
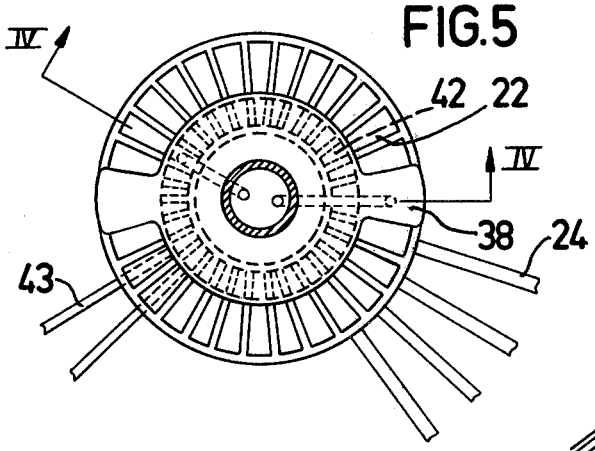
Figure 7:
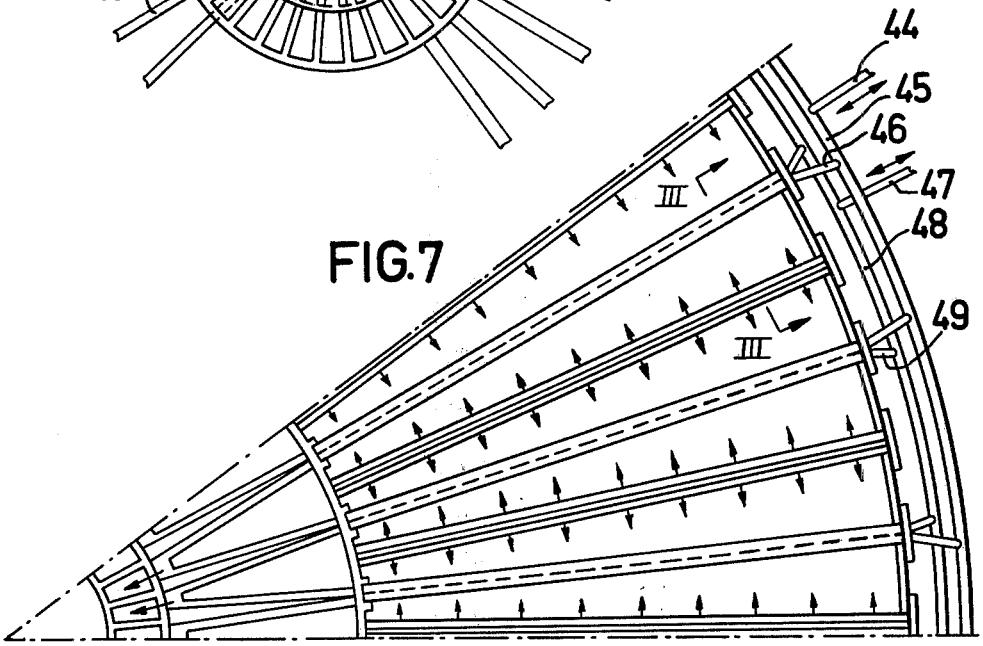
Figure 8:
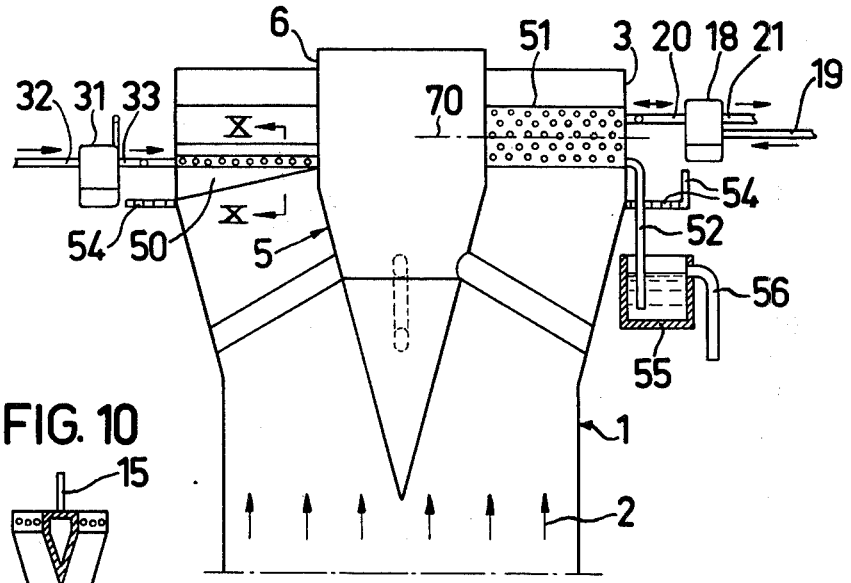
Figure 10:
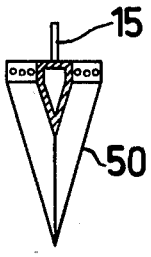
Figure 9:
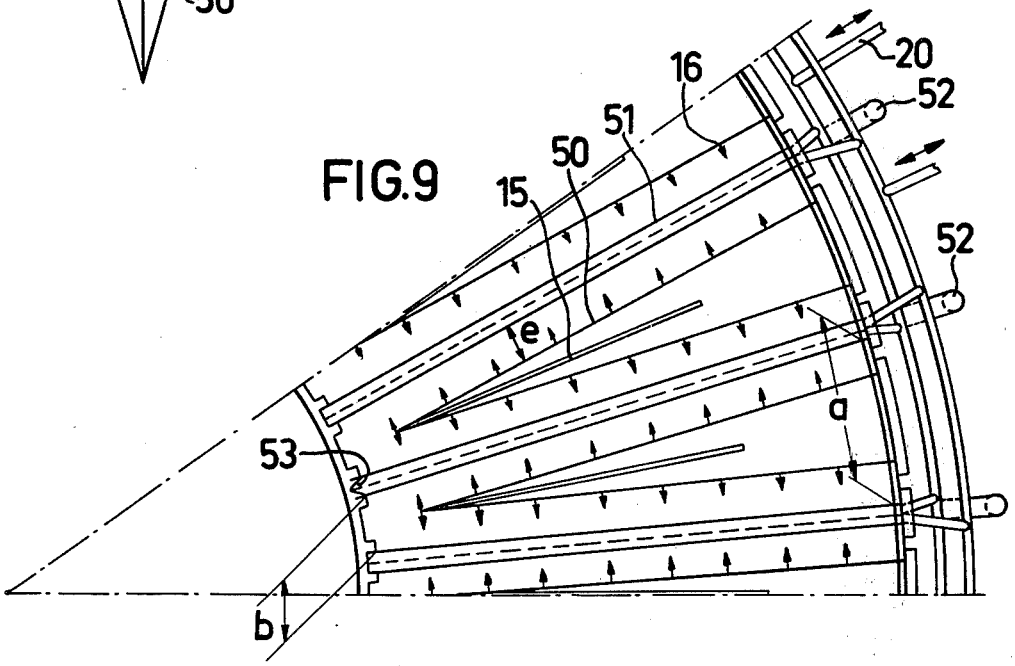

The invention is described in the following with reference to the accompanying schematic drawings, in which FIG. 1 is a sectional view showing one embodiment of the present invention, FIG. 2 is a view on a larger scale of the same embodiment shown in FIG. 1 seen from above, which view is limited to three screen bodies, a sector of 36° of the container, which indicates that the total number of screen bodies across the entire cross-section of the container for the embodiment shown is 10 times greater, i.e., 30 bodies, FIG. 3 is a cross sectional view taken along lines III—III of FIG. 2 and 7 and shows a suitable screen body with supply means for treatment liquid, FIGS. 4 and 5 show a valve means for closing the screen bodies intermittently and/or for transferring pressure impulses to the screen bodies and, when required, intermittently transferring treatment liquid to the supply means, FIG. 6 shows a stuffing box means for adding pressure impulses and treatment liquid, FIG. 7 shows a proposed connection of conduits for transferring pressure impulses to screen bodies divided by partition walls, FIG. 8 shows a sectional view of a further embodiment of the container with screen bodies and supply means, FIG. 9 shows the embodiment of FIG. 8 on a larger scale, FIG. 10 shows by way of a section a suitable design of a supply means for treatment liquid for this embodiment, said section being made along the line *x—x* in FIG. 8, FIG. 11 shows a sectional view of an embodiment intended for several treatment steps during the flow of the cellulose pulp through the container, FIG. 12 is a view of a modified embodiment.

In the Figures, 1 designates an upright, preferably cylindric container, the upper portion of which is shown in FIG. 1, and which is adapted to continuous or step-by-step flow of cellulose pulp with a pulp concentration of 6–20%, suitably 8–15% and preferably 10–12% in the direction indicated by arrows 2. A widened upper portion 3 of the container is provided with a plurality of screen bodies 4 disposed substantially on the same level. The screen bodies extend across the container, preferably radially or/substantially radially from the periphery of the widened container portion 3 to an inner hollow filling body 5. The filling body preferably is designed with a cylindric upper portion 6 and a conical lower portion 7 with an acute top angle so as not to disturb the uniform upward flow of the cellulose pulp. The filling body 5 is supported on stays or arms 8, the cavities of which are well adapted for the drainage of screened-off liquid. A tower scraper (not shown) of known kind can advantageously be supported in the filling body. The object of the tower scraper is to displace the cellulose pulp at the upper portion of the container outward to a drainage conduit or a shaft for transport of the pulp to a subsequent treatment step. (See FIG. 11). The cavity in the filling body may also be utilized for valve means, conduits, etc., as will become apparent from the following description. The diameters of the container 1, its upper portion 3, and the upper portion 6 of the filling body are to be chosen so that the area of the container does not decrease, or does not substantially decrease, in the flow direction of the cellulose pulp, even if the container portions 1 and 3 may have substantially the same diameters, which implies a lower flow rate at the lower portion of the container. Furthermore, the diameter ratio between the portions 3 and 6 should be chosen to be not greater than about 6:1, suitably not greater than 3:1, and preferably not greater than 2:1, so that the distance between the screen bodies at the periphery of the widened portion 3 will not be much too large in relation to the corresponding distance at the cylindric portion 6. FIG. 2 shows a diameter ratio of about 2.5:1. In order to achieve a uniform displacement, it is necessary to compensate for different distances between the screen bodies. This may render difficulties at normal operation conditions, if the diameter ratio exceeds 6:1.

When the aforesaid diameter ratio 2.5:1 is chosen, the distance *a* between the screen bodies at the periphery of the container will exceed the distance *b* at the filling body by about 2.5 times. At an equal degree of displacement, the necessary amount of treatment liquid will thereby decrease quadratically with the distance from the axis line of the container. This amplies that the screeningoff surfaces 9 of the screen bodies 4 are to be designed with decreasing height in the inward direction. In the example chosen, the height ratio between the height *c* of the screen surface at the periphery of the container and *d* at the filling body will be 6:1, or in any case of about this magnitude, which value will decrease to 4:1 at a ratio $a:b = 2$. Deviations, however, may occur in view of the fact that a number of factors affect the transverse flow of the treatment liquid and, for example, the friction conditions at screen surfaces of different sizes during the passage of the cellulose pulp. Therefore, it is here stated generally that the amount of supplied treatment liquid and preferably the size of the screen surfaces are with decreased distance to the axis line of the container to be reduced to a necessary degree, so that a uniform displacement across the entire cross-section of the container is achieved.

In the apparatus according to the invention the screen bodies 4 can be designed straight and of equal length. For technical reasons, with respect to manufacture and spare parts, the bodies should be made identical. This does not preclude, however, the utilization of different types, with respect to form, size, hole area, etc., for different operation conditions, particularly for screen bodies in a set of bodies arranged on different levels in relation to screen bodies comprised in another set. Each screen body 4 comprises a pair of wall portions 9 of opposed spaced relationship which are broken-through by means of slotting or perforation. The longitudinal direction of the slots should be substantially the same as the flow direction of the cellulose pulp. The broken-through wall portions transform upwardly and downwardly into portions 10 and 11, respectively, which preferably are not broken-through, so that a cavity 12 for the collection of separated liquid is formed. The lastmentioned portion 11 serves also as a groove for the discharge of separated liquid. The supply means 13 is an oblong hollow member, preferably a pipe 14, which may be provided on the upper side with a shield plate 15 for guiding the flow of processing liquid from holes 16 in the intended direction. The shield plate 15 increases the moment of inertia of the pipe 14 and, therefore, also has a strength-technical function. The plate is designed with the necessary height for achieving said two objects. The supply means may, if required, be provided with one or more additional pipes with shield plates arranged on different levels, as appears from the dashed-line completion 17 in FIG. 3. The supply holes 16 for treatment liquid may be arranged in a row, which in a section according to FIG. 1 is in parallel with a line through the lowermost row of screen holes on the screen surface 9. This implies, at the embodiment according to FIG. 1, that both the axis line of the pipe 14 and the lower edge of the screen body 4 are in parallel with a normal plane through the container. Different operation conditions, however, for example in radial direction of the container, may result in the angularity of the row of holes 16 in relation to the lowermost row of holes in the screen body brings about the most uniform displacement effect across the cross-section of the container. In a vertical direction, the treatment liquid may be supplied on a level, which lies below, above or on the same height as the lowermost portion of the screen surface, depending on the design of the screen set and container and on the flow-technical conditions for the cellulose pulp. The area of the holes 16 is to be chosen decreasing in the direction to the axis line of the container.

In order to facilitate at the liquid separation the movement of the cellulose pulp past and along the screen surfaces of the screen bodies, and in order to prevent material impressions in the screen openings, the screen bodies may be arranged so as to be intermittently movable in the axial direction of the container, in the manner disclosed in the Swedish patent specification 198 496. In order to achieve this effect, among others, U.S. Pat. Nos. 3,622,262 and 3,729,961 instead proposes that the inflow of the liquid into the cavities of the screen bodies shall be interrupted at suitable intervals, entirely or partially, and in U.S. Pat. No. 3,677,040 and U.S. Pat. application Ser. No. 476,076 it is proposed that the pressure impulses required for this purpose are produced by means of a gas, preferably air. Particularly, the two lastmentioned ones of these patents may advantageously be applied to the present invention. The device producing the pressure impulses may be a solenoid controlled by a time-relay which in a schematic way and in the form of one unit is shown in FIG. 1 and designated by 18. Upon impulse from time-relays, the solenoid establishes connection of the screen body 9 alternatingly with a pressure source (not shown) via conduits 19 and 20 and with the atmosphere, respectively, via conduits 20 and 21. The pressure impulses are supplied to one or more screen bodies 4 simultaneously according to a suitable pattern. During the pressure impulse, the outlet opening 22 of each screen body in a valve seat 23, which opening is connected to the screen body 4 via a conduit 24, may be held closed by a valve 25. After the impulse emission has ceased temporarily, the outlet opening 22 shall be exposed by a step-by-step or continuous turning of the valve, so that the cavity of the screen body communicates with the inner space 26 of the filling body 5 and drainage conduit 27. It is usually not necessary to hold the outlet openings of the screen bodies closed during the impulse emission by means of relay-controlled solenoids, and this is particularly the case when the pressure impulses are rapid and of short duration by mediation of gas, such as air. The valve means 23, 25 is a complement or an alternative to solenoids or similar valves. The embodiment according to FIG. 1, thus, would in this aforesaid respect very well have continuous and free communication with the space 26, i.e., the valve 25 being removed as shown in FIG. 2. The best effect during impulse emission at closed drainage conduit 24 is achieved especially with slow pressure impulses of longer duration.

The valve 18 may by means of the conduit 20 and conduits 28 and 29 be so connected that all screen bodies 4 are supplied simultaneously with pressure impulses, whereby the inflow of liquid to the screen bodies is temporarily interrupted across the entire cross-section of the container. A valve or a plurality of valves 18 may also be so connected that the inflow is not interrupted simultaneously but at a certain sequence. In this lastmentioned case, the bed of cellulose pulp between two screen surfaces will pass for a short period between one screen surface with full or partly interrupted inflow and one screen surface with unthrottled inflow. This should normally not result in an undesired displacement of the fibers forming the pulp bed, but the fibers will maintain their stationary position relative to each other. Possible inconveniences of this kind can be eliminated by each screen body 4 being provided with a partition wall 30. The cavities in each screen body half, which are served by the same supply means 14, are connected for simultaneous pressure impulses. When a section of the container with several screen bodies is supplied with simultaneous pressure impulses, only the screen bodies defining the sections must be provided with partition walls. With respect to standard, on the other hand, it may be suitable to provide all screen bodies with partition walls. Such a design with section-wise impulse emission is shown in FIG. 7. A number of screen body halves is served via conduits 44, 45 and 46, and the other halves are served via conduits 47, 48 and 49. When it is desired that the outlet openings of the screen bodies are closed at impulse emission across the entire cross-section of the container, the valve preferably is designed movable in the axial direction of the container, in such a manner that the closing is broken in the upper position.

In liquid-treating, for example, washing of cellulose pulp, it is desired that supplied liquid entirely or partially replaces the liquid in which the cellulose-containing material is suspended. The replacing liquid is added, as already mentioned, from a supply means, preferably a cylindric or flattened pipe with one or, as appears from FIG. 3, a pair of hole rows with intermediate shielding plates. The hole division in the longitudinal direction of the pipe is chosen sufficiently small for obtaining a uniform spread-out of the replacement liquid in radial direction of the container. The spread of the liquid can take place in a continuous manner. However, particularly at the spread of fibrous backwater, the hole diameter should not be less than 4–5 mm in order to eliminate the risk of hole clogging. This may give rise to the problem, that the amount of supplied replacement liquid will be too great at the pressure drop, which is required from the holes in order to achieve, that from holes disposed at different distances from the inlet place of the pipe, equal amounts of liquid are drained. This problem may also exist at the spread from holes with a smaller diameter.

In order to overcome the a foresaid inconvenience, it is proposed to add the replacement liquid intermittently under pressure above atmospheric pressure. For this purpose, a further valve is provided, preferably a relay-controlled solenoid 31. Upon impulse from time-relays, the solenoid connects via conduits 32 and 33 the supply means at predetermined intervals with a container (not shown) for replacement liquid. Between the supply periods, the valve holds the conduit 33 closed to prevent fiber cloggings in the holes 16 and/or leakage out into the container of replacement liquid at undesired times. As there is also risk of clogging by fibers from the cellulose pulp through, intermittent addition of clean treatment liquid may also be favorable.

The valve means shown in FIGS. 1, 4 and 5 may replace the valves 18 and 31 and be designed for the functions of supplying pressure impulses to the screen bodies, when required with simultaneous closing of their outlet openings and, when required, for the addition of treatment liquid at timed intervals. The medium, gas of liquid, for transferring pressure impulses to the screen bodies is supplied from a conduit 34 via a stuffing box 35 on the rotary valve axle 36 and via a conduit 37 to the outlet opening 22 of the screen body 4. In the example shown, said opening is held closed during the impulse emission by a member 38 projecting on the valve 25. In an analogous manner, treatment liquid is supplied from a conduit 39 via a stuffing box 40 and a conduit 41 to an inlet opening 42 in the valve seat 23, which inlet opening communicates with a supply means 13 by the conduit 43. The compartments 42 are held continuously closed, as appears from FIG. 5.

Irrespective of the valve means used, the pattern for the pressure impulses to the screen bodies and/or the supply means for treatment liquid can be chosen within wide limits with respect to, for example, the number of simultaneous pressure impulses, the succession about the container for the screen bodies, and respectively, supply means and the mutual succession between the same. It may be unsuitable, that pressure impulses are supplied simultaneously to a supply means and the cavity inside of the two screen surfaces being served by said means. At the valve means according to FIGS. 4 and 5, the number of connecting openings 22, 42 can be chosen proportional to the number of means 4, 13 connected to each opening.

The embodiment according to FIGS. 8 and 9 has been proposed as an alternative embodiment, at which the different distances *a* and *b* between the screen bodies are compensated for whereby the supply means 50 for treatment liquid is designed so inward tapering that the flow path *e* of the liquid to each screen body 51 is of equal length at the periphery of the widened portion 3 of the container 1 as at the periphery 6 of the filling body 5. In order to prevent disturbance to an undesired degree of the upward flow of the cellulose pulp, the supply means 50 has a wedge-shaped section, as shown in FIG. 10. The screen bodies 51 are designed with equal height along their entire length.

At the embodiment described last, in addition to conduits 20 and 33 for the transfer of pressure impulses and, respectively, treatment liquid, also conduits 52 for drained liquid have been provided at the periphery of the container 3. It is hereby gained that the connections are easily accessible from outside, which facilitates the exchange of screen bodies and supply means. Said bodies and means can even be dismounted, and, respectively, mounted during the ongoing passage of cellulose pulp through the container. One prerequisite in this respect is, that stop valves for the conduits and preferably necessary guide and shielding arrangements for the movement of the screen bodies and supply means in substantially radial direction are provided. The movement of the screen bodies to the intended position is facilitated by a wedge-shaped design of the inner portion 53, as appears from FIG. 9. The laying of the conduits facilitates under any circumstances the control and service. The flow from each screen body in the conduit 52 a.o. may be controlled visually, when a portion of the conduit is made of transparent material. The same control possibilities are obtained, irrespective of the conduit laying, when a portion of the screen body end wall located at the periphery of the container is made of transparent material. Said end wall portion may also advantageously be designed as or with a detachable cover, so that cleaning can be carried out from a service platform by means of a brush or by scavenging portions of the screen body which possibly are heavily clogged. In FIG. 8 a service platform 54, preferably arranged about the container, and a liquid trap 55 with drain 56 are indicated schematically.

The described method of exchange can also be applied to the embodiments in FIGS. 1 and 11 when conduits from the interior of the container are provided with connecting couplings which, for example, seal at friction contact.

The embodiment according to FIG. 11 can be utilized advantageously when several processing steps in the same container are desired, for example, at so-called dynamic bleaching. In the container 57 a plurality of sets of screen bodies 58 with supply means 59 for bleaching liquid and/or extraction liquid and/or washing liquid are shown. The cellulose pulp is intended to be charged through the connecting piece 60 by means of a so-called thick stock pump for passage upwards in the direction of the arrows 61. Conduits for drained liquid are schematically shown and designated by 62, 63 and 64. The screen bodies 58 and supply means 59 need not be arranged directly above each other, but may be offset in peripheral direction, so that, for example, the screen bodies 58 on one level, in a view from above, are disposed centrally between the screen bodies 58 on the level next below. At the upper portion of the container, a tower scraper 65 with a drive wheel 66 is provided in known manner to discharge the pulp to a shaft 67. The tower scraper may be designed so that the scraper blades 68 describe a conical rotation area 69, the generatrix of which is substantially in parallel with the central line 70 through the broken-through (perforated) portion of the screen surface 58 and/or with the supply openings for treatment liquid in the supply means 59, in order to obtain as uniform pressure conditions as possible along the radial extension of the means 58, 59. Supply conduits for pressure impulses 71 and 72 to the screen bodies 58 and, respectively, supply means 59 are drawn through a cavity 73 in the driving and supporting axle 74 of the tower scraper. Each of the conduits is connected to a main pipe 75 and 76, respectively, located in a filling body 77 in the container 57. From said main pipes extend branch pipes 78 and 79 to respective means. Corresponding conduit systems (not shown) for screen bodies are arranged on lower levels. A central conduit system, thus, is established which shortens the length of the conduits compared with a conduit system at the periphery of the container. The number of sets of screen bodies on different levels is chosen with respect to the desired number of treatment steps. The vertical distance depends on reaction times and, therefore, said distance in proportion to the container diameter may be substantially greater than shown. At bleaching as well as washing after the digestion of the pulp, it is often necessary to concentrate the pulp at the beginning of the treatment procedure. Such a concentration can be carried out by means of a set of screen bodies arranged on the same level, preferably on the lowermost level with respect to the order of the treatment steps relative to each other. At a pure concentration, supply means for treatment liquid are not required, as already mentioned.

Two different proposals were made to compensate for different distances between screen bodies at the periphery of a container and at a filling body located centrally in the container, viz. to design the screen surfaces with a height decreasing from the periphery of the container and, alternatively, to decrease the widths of the supply means in the normal plane of the container in a corresponding way. Both said proposals may advantageously be applied simultaneously to a set of screen bodies with associated supply means. It is hereby gained that the screen surfaces can be designed with a height, which decreases inwards at a smaller degree, and the supply means can be designed with a smaller width at the periphery of the container. It is also possible to design the screen bodies so that both height and width decrease inward, as the only measure to compensate for the distances, or in combination with supply means having a width decreasing inward.

FIG. 12 shows a further embodiment, at which the container has rectangular shape. The container is designated by 80, the screen bodies and supply means are designated by 81 and 82, respectively. there are further shown in a schematic way conduits 83 and 84 for transfer of pressure impulses and processing liquid, respectively, and drain conduits 85. The screen bodies have equal height along their length, and the supply means have equal width. Several containers of this kind may be arranged adjacent each other or with intermediate wedge-shaped filling bodies, so that a tower with polygonal cross-section and with a polygonal inner filling body is formed.

In the description of the embodiments according to the present invention, it was stated, that the pressure impulses are to be emitted at definite time intervals. This definition does not restrict the possibility of applying any pulsation method as described in U.S. Pat. Nos. 3,622,262; 3,729,961; 3,677,040 and U.S. Pat. application Ser. No. 476,076. The pulsations, thus, may take place intermittently or continuously, by the mediation of liquid or gas, etc. One interesting application is, that gas, preferably air, is pulsated continuously, for example by the device shown in FIG. 2 in U.S. Pat. Nos. 3,662,262 and 3,729,961. A pressure difference is maintained between the outside and inside of the screen surface, in such a manner, that inflow of liquid takes place to the cavity of the screen body. This pressure difference can be obtained from the pulp column above the screen body, or in another way. At the invention, also gas phase bleaching may be carried out, in which connection the pulp concentration must be chosen higher than previously stated, or 20–50%, preferably 25–35%. The gaseous bleaching agent is added under the necessary pressure either through means of the kind of screen bodies 58 or of the kind of supply means 59. The addition takes place intermittently at definite time intervals or with substantially continuous pulsation. During the bleaching step it is neither possible nor right to drain liquid from the pulp column. The pulsation has the object to prevent clogging of the supply holes for the gaseous bleaching agent and to facilitate the movement of the cellulose pulp along the outside of the supply means during the penetration of the gaseous bleaching agent into the pulp column.

Although this invention has been described with respect to its preferred embodiments, it should be understood that many variations and modifications will now be obvious to those skilled in the art, and it is preferred, therefore, that the scope of the invention be limited, not by the specific disclosure herein, but only by the appended claims.

What is claimed is:

1. An apparatus for treatment of cellulose pulp comprising a vertical treatment container adapted for axial flow of cellulose pulp therethrough, said container having a substantially circular cross-section, a filling body centrally located within said container, a plurality of screen bodies for the collection of liquid separated from the cellulose pulp, and means for mounting said screen bodies in the container, said screen bodies extending from the periphery of said container to said filling body and being arranged substantially radially throughout the cross-section of said container, each said screen body including two screen body walls of opposed spaced relationship with a least one of said screen body walls being pervious, each screen body wall being disposed in a separate, substantially vertically extending plane, each screen body including at least one cavity therein being defined by said screen body walls, said at least one cavity extending along the entire radial and vertical extents of said screen body.

2. The apparatus of claim 1 wherein said screen body walls comprise screen surfaces and the height of said screen surfaces is substantially constant along the radial extension of said screen bodies.

3. The apparatus of claim 1 wherein said screen body walls comprise screen surfaces and the height of said screen surfaces decreases in a radial direction with increased distance from the periphery of said container.

4. The apparatus of claim 3 wherein the ratio of the height of said screen surfaces at the periphery of said container and the height of said screen surfaces at said filling body is substantially equal to the square of the ratio of the distance between the screen surfaces of adjacent screen bodies at the periphery of said container to the distance between the screen surfaces of adjacent screen bodies at said filling body.

5. The apparatus of claim 3 wherein the ratio of the height of said screen surfaces at the periphery of said container and the height of said screen surfaces at said filling body is equal to the ratio of the distance between the screen surfaces of adjacent screen bodies at the periphery of said container and the distance between the screen surfaces of adjacent screen bodies at said filling body.

6. The apparatus of claim 1 wherein said screen bodies are wedge-shaped, the distance between said screen body walls of each said screen body decreasing with increased distance from the periphery of said container.

7. The apparatus of claim 1 wherein said screen body walls are substantially parallel.

8. The apparatus of claim 1 further comprising means connected to said screen bodies for transfer of pressure impulses of fluid from a pressure source.

9. The apparatus of claim 8 wherein said screen bodies further comprise normally open drain means to hold said drain means closed during the transfer of pressure impulses.

10. The apparatus of claim 9 further comprising valve means operative to transfer pressure impulses to said screen bodies and to close said drain openings during the transfer of said pressure impulses.

11. The apparatus of claim 8 wherein said means for transfer of pressure impulses are connected to said screen bodies at the periphery of said container.

12. The apparatus of claim 8 wherein said means for transfer of pressure impulses are connected to said screen bodies at said filling body.

13. The apparatus of claim 1 wherein each said screen body further comprises a partition wall disposed between said screen body walls, said screen body walls and said partition wall defining two screen body cavities.

14. The apparatus of claim 13 further comprising means connected to each said screen body cavity for transferring pressure impulses of fluid from a pressure source.

15. The apparatus of claim 1 further comprising supply means for supplying treatment liquid to said container, said supply means being disposed between adjacent screen bodies.

16. The apparatus of claim 5 wherein said supply means include shield means for guiding treatment liquid supplied on both sides of said shield means in a desired direction.

17. The apparatus of claim 15 wherein said treatment liquid supply means are arranged substantially radially throughout the cross-section of said container and extend from the periphery of said container to said filling body, said supply means having decreasing width with increased distance from the periphery of said container.

18. The apparatus of claim 17 wherein in said supply means include a plurality of supply openings in spaced relationship to each other along the length of said supply means, the width of said supply means decreasing such that the distance between said supply means and an adjacent screen body is substantially equal at the periphery of said container and at said filling body.

19. The apparatus of claim 15 wherein said apparatus further comprises a pressurized vessel of treatment liquid and at least one conduit provided with valve means and connected to said treatment liquid supply means for transferring pressure batches of treatment liquid to said treatment container.

20. The apparatus of claim 19 wherein said conduit is connected to said treatment liquid supply means at the periphery of said container.

21. The apparatus of claim 15 wherein said treatment liquid supply means are of substantially identical design to said screen bodies.

22. The apparatus of claim 15 wherein said liquid supply means are wedge-shaped, the distance between walls of said liquid supply means decreasing with increased distance from the periphery of the container.

23. The apparatus of claim 1 wherein said plurality of screen bodies is a first plurality of screen bodies and said apparatus further comprises at least a second plurality of screen bodies mounted and arranged substantially radially throughout the cross-section of said container on a different horizontal plane than said first plurality of screen bodies.

24. The apparatus of claim 1 further comprising a tower scraper at the upper portion of said treatment container for discharging treated cellulose pulp to a shaft.

25. The apparatus of claim 24 wherein said tower scraper comprises a scraper blade having a lower edge and wherein said lower edge during rotation of said tower scraper defines an area the generatrix of which when seen in an axial plane through the axis line of the container is parallel to a line defined by half the height of said screen surfaces of said screen bodies.

* * * * *

UNITED STATES PATENT OFFICE

CERTIFICATE OF CORRECTION

Patent No. 3,985,005 Dated October 12, 1976

Inventor(s) Nils Gustav Leffler

It is certified that error appears in the above-identified patent and that said Letters Patent are hereby corrected as shown below:

Column 7, line 28, after "pulp" insert -- flowing --, line 36, the word "of" should read -- or --.

Signed and Sealed this

Fourteenth Day of December 1976

[SEAL]

*Attest:*

RUTH C. MASON
*Attesting Officer*

C. MARSHALL DANN
*Commissioner of Patents and Trademarks*